US005380225A

United States Patent [19]

Inaoka

[11] Patent Number: 5,380,225

[45] Date of Patent: Jan. 10, 1995

[54] ELECTRICAL CONNECTOR

[75] Inventor: Seiji Inaoka, Tokyo, Japan

[73] Assignee: Minnesota Mining and Manufacturing Company, St. Paul, Minn.

[21] Appl. No.: 88,261

[22] Filed: Jul. 7, 1993

[30] Foreign Application Priority Data

Jul. 24, 1992 [JP] Japan ..... 4-198684

[51] Int. Cl.[6] ..... H01R 17/00

[52] U.S. Cl. ..... 439/660; 439/284

[58] Field of Search ..... 439/660, 284–293, 439/861, 862, 676, 60, 465, 467, 405

[56] References Cited

U.S. PATENT DOCUMENTS

| | | | |
|---|---|---|---|
| 4,108,525 | 8/1978 | Lincoln | 439/284 |
| 4,630,876 | 12/1986 | Greenberg et al. | 439/291 |
| 4,804,336 | 2/1989 | Miller et al. | 439/218 |
| 5,181,855 | 1/1993 | Mosquera et al. | 439/291 |

*Primary Examiner*—David L. Pirlot

*Attorney, Agent, or Firm*—Gary L. Griswold; Walter N. Kirn; David W. Anderson

[57] ABSTRACT

A connector includes a jack and a plug having corresponding staggered contacts formed by alternating projections and recesses which permits the connector to have a higher contact density than conventional connectors.

2 Claims, 3 Drawing Sheets

ELECTRICAL CONNECTOR

FIELD OF THE INVENTION

This invention relates to electrical connectors used in electronic computers, control appliances, communications and other electronic appliances of industry, and more particularly to connectors for mutual connection of electric wire cables and/or printed circuit boards.

BACKGROUND OF THE INVENTION

The structure of a typical prior art connector will be described in detail referring to the accompanying drawings, FIGS. 4 and 5.

The conventional connector includes a jack 10 (FIG. 4) and a plug 10*a* (FIG. 5) for insertion into the jack 10 to make an electrical connection therebetween, the jack 10 having a housing 11 formed of insulating material such as resin and having a square or rectangular cross section and electric contact elements 12 equally spaced on the inside wall of the housing 11.

The plug 10*a* includes a housing 11*a* formed of insulating material and electric contact elements 12*a* placed on a center portion of the housing 11*a* corresponding to the electric contact elements 12 of the jack 10.

When the plug 10*a* is inserted into the jack 10, each of electric contact elements 12 and 12*a* are in contact and an electrical connection is obtained between the plug 10*a* and the jack 10.

A common demand among customers is a reduction in the space between the electric contact elements which would produce connectors which are highly dense compared to the connector just described. However, the smaller the space between the contact elements, the greater the possibility of short circuits occurring between the adjacent electric contact elements 12 in the jack 10 and between the adjacent electric contact elements 12*a* in the plug 10*a* or increased crosstalk due to the electrical and magnetic induction. Thus simply reducing the gap between the electric contact elements in a conventional connector has limitations.

Therefore the object of the present invention is to supply miniaturized, highly dense, low cross talk connectors that are free of short circuits between the electric contact elements although the space between the electric contact elements is reduced.

SUMMARY OF THE INVENTION

According to the present invention, a connector includes a connector jack and a connector plug for inserting into the jack to make electric connections therebetween, the jack having a housing and electrical contact elements, the housing being formed of insulating material having a square or rectangular cross section, and wherein opposed inside walls have a plurality of body projections and body recesses that are alternately equally spaced, with the electrical contact elements placed on each of the body projection and the body recess. The plug includes a housing and electrical contact elements, with the housing being formed of insulating material having a center portion having body recesses and body projections corresponding to the body projections and the body recesses of the jack, with the electrical contact elements placed on each of the body recess and the body projection.

Further, the connector preferably has a distance between the surfaces of the body projections and the surfaces of the body recesses of the jack which is more than 1.5 times the distance between adjacent body projections and the body recesses.

The connector also preferably has the surfaces of the body recesses and the surfaces of the body projections angled with respect to each other at an angle which is greater than 60 degrees but less than 120 degrees.

BRIEF DESCRIPTION OF THE DRAWINGS

The present invention will be more thoroughly described with respect to the accompanying drawings, wherein like numbers refer to like parts in the several views, and wherein.

DESCRIPTION OF THE PREFERRED EMBODIMENT

Figure 1:
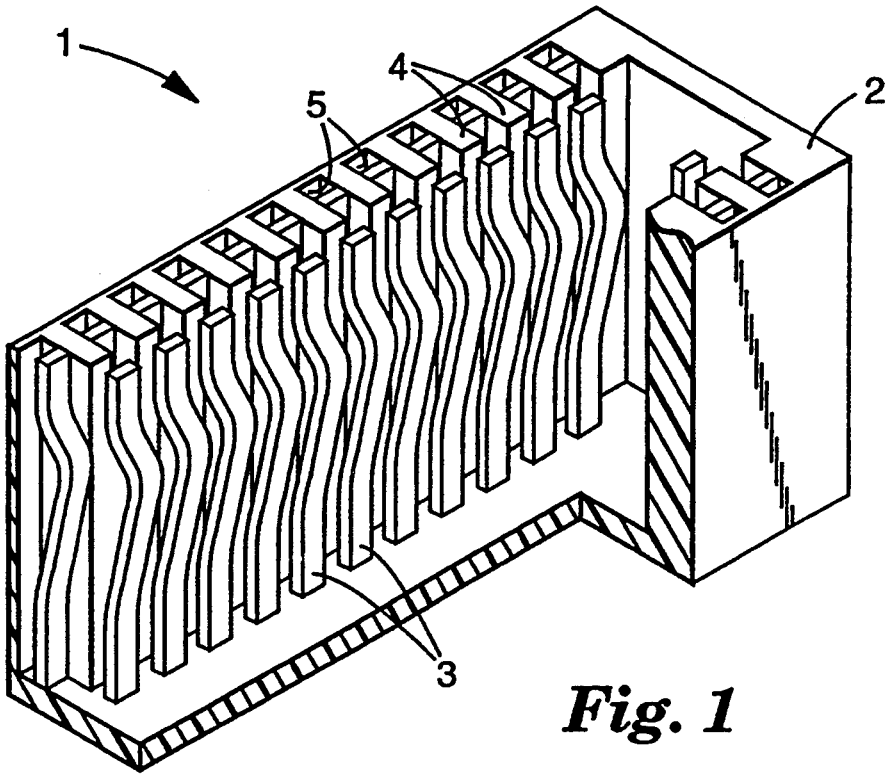
FIG. 1 is a partially broken perspective view of a jack portion of an embodiment of the present invention.
Figure 2:
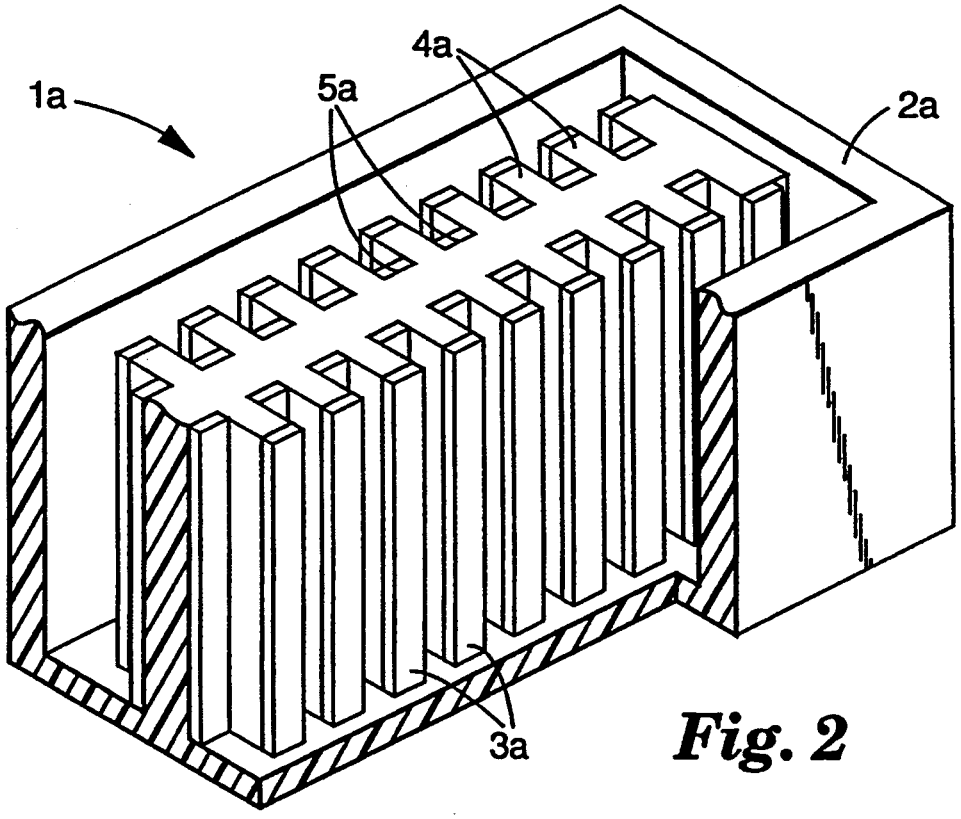
FIG. 2 is a partially broken perspective view of a plug of an embodiment of the present invention.
Figure 3:
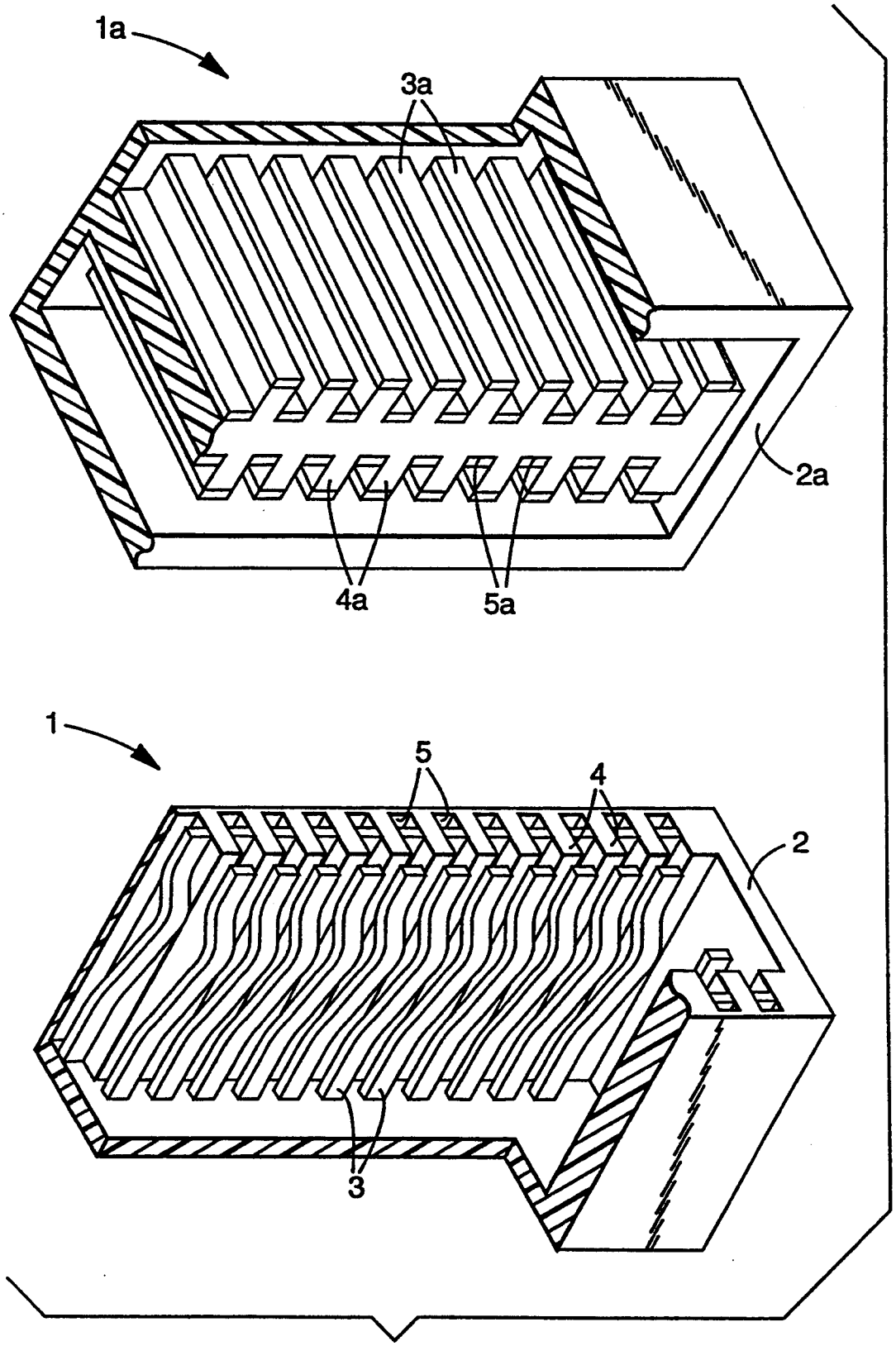
FIG. 3 is a partially broken perspective view of a connector of an embodiment of the present invention showing that the plug about to be inserted into the jack.
Figure 4:
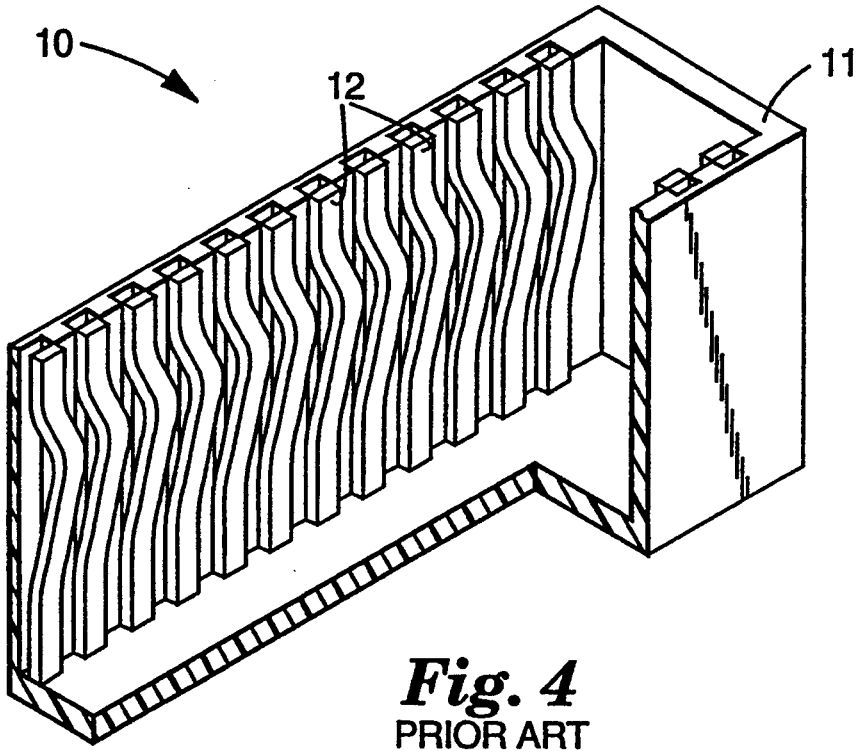
Fig. 4 PRIOR ART
FIG. 4 is a partially broken perspective view of a jack of the prior art.
Figure 5:
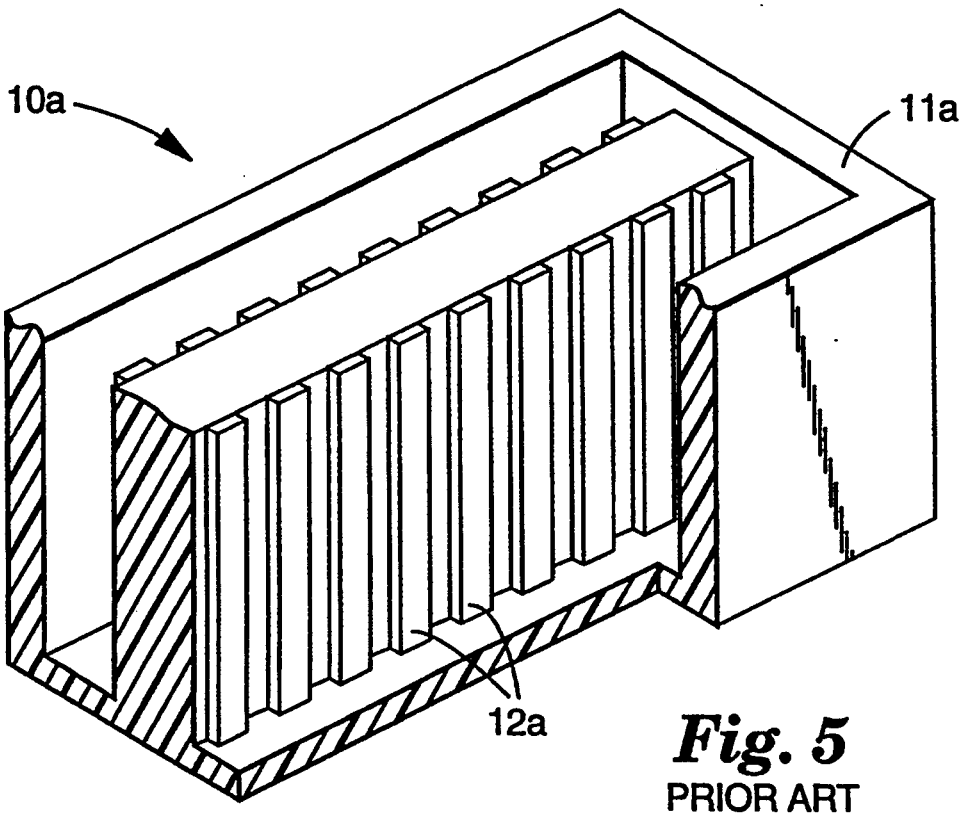
Fig. 5 PRIOR ART
FIG. 5 is a partially broken perspective view of a plug of the prior art.

The connector of the present invention comprises the jack of FIG. 1 and the plug of FIG. 2. The jack 1 includes a housing 2 and electrical contact elements 3. The housing 2 is formed of an insulating material, and the shape of the transverse cross section is preferably square or rectangular, although other shapes such as trapezoidal or oval could be useful. Opposed inside walls have body projections 4 and body recesses 5 alternately and equally spaced. Each body projection 4 and body recess 5 has electrical contact elements 3 thereupon.

The plug 1*a* includes a housing 2*a* and electrical contact elements 3*a*. The housing 2*a*, the body of which is formed of insulating material, has a center portion having body recesses 5*a* and body projections 4*a* corresponding to the position of body projections 4 and body recesses 5 of the housing 2 of the jack 1.

Each body projection 4 and 4*a* and body recess 5 and 5*a* have electrical contact elements 3 and 3*a* thereupon.

The distance between the surfaces of the body projections 4 and the surfaces of the body recesses 5 of the jack 1 is preferably equal to or greater than 1.5 times the distance between adjacent body projections 4. Therefore, after the plug 1*a* is inserted into the jack 1, adjacent electrical contact elements are completely separated from each other by the housing 2 and 2*a*, and neither cross talk nor short circuits between the electrical contact elements 3 and 3*a* can occur.

Furthermore, in the connector 1, 1*a*, the angle of the contact surface of the body recess 5 with respect to the surface of the body projection 4 is more than 60 degrees and less than 120 degrees, so that contact pressure between the electrical contact elements 3, 3*a* can be changed depending on the use of the product.

Although not specifically shown, it should be understood that the contacts 3, 3*a* of the connector jack 1 and plug 1*a* extend through the material of the housings 2 and 2*a* for electrical connection to such further electrical or electronic devices such as wires or circuit boards. The shapes of the ends of the contacts 3, 3*a* which extend beyond the jack 1 or the plug 1*a* are well known for the particular connection desired.

I claim:

1. A connector comprising:

a connector jack and a connector plug for inserting into said jack to make electric connections therebetween, said jack comprising:

a housing formed of insulating material and having a base and upstanding walls extending from said base to define an enclosed volume within said walls, said walls including a number of spaced projections extending therefrom to define body projections having surfaces in a plane substantially perpendicular to said base and body recesses having surfaces in a plane substantially perpendicular to said base between said projections which body recesses are recessed with respect to said body projections; and electrical contact elements placed on said body projections and said body recesses of said jack;

said plug comprising:

a housing formed of insulating material and having a base and a center portion upstanding from said base, said center portion including body recesses having surfaces in a plane substantially perpendicular to said base and body projections having surfaces in a plane substantially perpendicular to said base corresponding to said body projections and said body recesses of said jack for engagement therewith;

and electrical contact elements placed on said plug body recess surfaces and said body projection surfaces of said plug for electrical connection with said contact elements of said jack when said plug and said jack are interconnected.

2. A connector according to claim 1 wherein the distance said body projection surfaces of said jack project beyond said surfaces of said body recesses of said jack is more than 1.5 times the distance between adjacent body projections of said jack.

* * * * *